United States Patent [19]

Bickel et al.

[11] 4,252,065

[45] Feb. 24, 1981

[54] PASSAGEWAY SYSTEM FOR VEHICLES

[75] Inventors: Hans Bickel, Beringen, Switzerland; Hans H. Engelhardt, Ohningen, Fed. Rep. of Germany

[73] Assignee: SIG Schweizerische Industrie-Gesellschaft, Neuhausen, Switzerland

[21] Appl. No.: 965,382

[22] Filed: Dec. 1, 1978

[30] Foreign Application Priority Data

Dec. 9, 1977 [CH] Switzerland ..... 15129/77

[51] Int. Cl.[3] ..... B61D 17/22; B60D 5/00

[52] U.S. Cl. ..... 105/10; 105/8 R; 105/22

[58] Field of Search ..... 105/8, 10, 22

[56] References Cited

U.S. PATENT DOCUMENTS

| | | | |
|---|---|---|---|
| 1,012,451 | 12/1911 | Schmidt | 105/10 |
| 1,225,161 | 5/1917 | O'Connor | 105/22 |
| 2,193,156 | 3/1940 | Antoine | 105/8 |
| 2,826,998 | 3/1958 | Dean et al. | 105/10 |
| 3,486,464 | 12/1969 | Dean et al. | 105/8 |

*Primary Examiner*—Richard A. Bertsch

*Attorney, Agent, or Firm*—Browdy and Neimark

[57] ABSTRACT

A passageway system (vestibule system) for providing a space and passage for passengers to walk between two vehicles, especially railway cars. In order to provide complete protection from the elements, the entire passageway is surrounded by a sealing membrane and the two separable portal halves are joined together and are held in a well-defined central position. Due to the construction of the passageway as a framework held entirely within the fully surrounding bellows, the passengers are protected in all positions of the passageway and the associated railways cars. The support frame for the passageway may include support arms which carry the entire weight of the passageway and permit the use of vehicles couplers that cannot provide a support function. The passageway includes bridge members, one of which is attached to the threshold of the car and the other is attached to the threshold of the central portal and the two bridge elements cooperate by gliding on top of one another in the manner of fish scales. The passageway is able to accommodate any rotations and displacements which occur during the normal motion of coupled vehicles. When suspension failure occurs in one of the vehicles, the weight of the passageway is entirely absorbed by the intact car.

34 Claims, 15 Drawing Figures

PASSAGEWAY SYSTEM FOR VEHICLES

FIELD OF THE INVENTION

The invention relates to a passageway system for providing an access between two coupled vehicles, especially railway cars. More particularly, the invention relates to a passageway system which defines a portal having two halves, each of which is associated with one of the coupled railroad cars. Disposed between each of the end frames of the railroad car and the associated portal half is a set of at least two pivoted linkages and a multi-part, movable bridge which constitutes a walkway, the bridge having a pivotable bridge plate which pivots around the threshold of the end face opening of the railroad car. At the end of the portal, the bridge includes members that are mounted to the threshold of the portal. The bridge plate and the bridge members lie on top of one another and slide in the manner of fish scales.

BACKGROUND OF THE INVENTION

In a known system of the general type described above, for example that described in U.S. Pat. No. 2,826,998, the two pivoted linkages are disposed above and below the passageway and the lower of the two pivoted linkages includes a lightly domed bridge plate which is pivotable around a transverse axis disposed at the face end of the carriage box. Other bridge members, on which the bridge plate lies in scale-like manner, are supported on the threshold of the portal frame either directly or by means of a support system which is itself supported by the railway coupling lying below, as is the portal frame. A disadvantage of this construction is that the coupling must cooperate in the function of the passageway system and is thus loaded by the portal halves. This type of construction makes the use of non-loadable couplings impossible. Furthermore, the known construction cannot accommodate substantial differences in height as between the two carriage frames which may take place if one of the two railway cars experiences a spring breakage.

Further known is a passageway system as described in U.S. Pat. No. 1,012,451, in which each of the portal halves is supported from below by a coupling carrier and from above by a pivoted linkage connected in the region of the carriage roof. This pivoted linkage includes a telescoping device which may be pivoted around a vertical axis mounted at the carriage but at some distance from the end face of the carriage box and located in the interior of the carriage box. In the region lying somewhat outside of the plane defining the end face of the carriage box, the spring-tensed telescoping device has mounted to it a lever arm which pivots around a vertical axis, the other end of the lever arm being fastened to a vestibule frame of the associated vestibule half. In this disposition, the vestibule half is carried by one of the coupler carriers and thus shares in the lateral motion of the coupler. The bridge which the passengers use in their passage from one car to the other includes a rigid plate extending from the end face of the carriage box on which lies a bridge plate that can glide on the rigid plate in the manner of a fish scale and which is mounted movably around a transverse axis at the threshold of the vestibule frame.

SUMMARY OF THE INVENTION

It is an object of the present invention to provide a passageway system in which the two connected portal halves are always held in a well-defined central position and in which the walkway bridge is so guided as to insure that the movement and the presence of passengers in the passageway remain without danger and without unpleasant effects and disturbances.

This object is attained according to the present invention in an apparatus of the type described above, by providing that the transfer bridge is supported by a carrier system contained entirely within a per se known and fully enclosing diaphragm or bellows.

It is an advantage of this disposition that the passageway system can operate without being supported by the coupler insofar as required by the type of coupler used. The carrier system which is itself supported on the one side by the end face of the carriage frame and at the other side by the associated portal frame supports the portal halves and may, if necessary, also support the weight of any passengers present in the passageway system. The carrier system also permits both parts of the transfer bridge, i.e., the bridge plate and the bridge members, to be movable about transverse axes, without making one of the bridge elements rigid because neither of the bridge elements is required to perform a carrying support function for the other, rather are both bridge elements supported by the carrier system.

However, the invention also relates to a passageway system which includes an upper guidance for the central portal which is located above the usable passageway. The upper guidance has an arm which pivots around a vertical axis mounted at the top part of the carriage end frame.

Based on a known passageway system of this type as described in U.S. Pat. No. 1,012,451, the aforementioned object of the invention is attained by providing a slide on the arm which can glide in the longitudinal direction and to dispose on the slide a carrier bracket that can pivot about a transverse axis and which is connected with the portal half by a pivot. A particular advantage of this embodiment of the upper pivoted linkage is that it cannot only guide the portal but can also completely support its weight including any load due to the presence of passengers if required. This will be required when the coupler cannot be loaded or is not intended to be loaded.

The solutions provided by the invention make possible a safe and comfortable use of the passageway by the passengers who are reliably protected against any effects of the weather or the environment by the surrounding rubber membrane which also surrounds the lower bridge because the membrane seals the space against draft, water, snow, dust, sand, smoke and noise. This type of seal is of significance especially in air-conditioned vehicles due to the good thermal and acoustical insulation which it affords. Finally, the effective seal makes it possible to dispense with additional end face doors and/or compartment doors which represents an advantage with respect to the weight as well as to the cost.

An advantage of the passageway system according to the invention is also the large usable interior cross section and the substantially continuous flat floor without any ramps or steps worth mentioning. Thus, the passageway can be used for the comfortable circulation of passengers during normal operation, for utilization as a standing room in heavy traffic and as an escape route from one carriage to another. Finally, the passageway system according to the invention permits sufficient mobility to accommodate any occurring mutual motions or positions of the coupled car boxes. The system can accommodate even the smallest of track curvatures, as well as deliberately transversely inclined carriage boxes, large irregularities in the track and any motions due to vehicle suspension and vehicle coupling. A final advantage is the possibility of simple and reliable joining and separating of the passageway system when the railway cars are coupled or uncoupled. The couplings used may be automatic as well as manually actuated couplers and possibly permanent or semi-permanent couplers.

The passageway system according to the invention accommodates any rotations or displacements occurring during the trip such as the two car ends execute relative to one another in all directions when coupled. As will be explained in detail below, these motions can be separated into six components of motion in a spatial cartesian coordinate system, i.e., into displacements and rotations around all three major axes.

In a preferred exemplary embodiment, the carrier system for the passageway includes a bridge guidance having a bridge support mounted on the car frame by a two-axis pivot, the bridge guidance supporting the bridge part attached to the car box and guiding, telescopically and displaceable in the longitudinal direction, a bridge support located at the end of the portal, the latter being attached to the portal half with a ball joint. This embodiment of the carrier system and the type of disposition and construction of the pivots is especially advantageous.

In another preferred embodiment of the invention, there is provided a cover which includes two cover plates at each end of the vehicle, one of the cover plates being pivoted at the car box around a transverse and a longitudinal axis and the other being pivoted at the central part of the portal about a transverse and vertical axis. This covering results not only in an attractive appearance of the interior space of the passageway but also provides an additional feeling of security for the occupants. Finally, the covering hides the rubber membrane and thus protects it against deliberate damage. The cover plates are preferably provided as partially overlapping plates guided by a telescopic guidance, one end of which is mounted at the carriage box and the other at the central portal. The two plates are preferably so embodied that they result in a gap-free covering. Finally, these plates can also be so formed as to cover a region above the telescopic guidance so that the latter may serve for supporting the sealing membrane.

In a preferred embodiment of the invention, in which a per se known lower releasable coupler rod is provided, which is attached to the car box with a ball joint and with longitudinal elasticity, the coupler rods guide the associated portal half in the longitudinal and transverse directions by means of a pivot. The coupler part of the one car box may be rigidly or fully releasably connected to an appropriate coupler member of the other car box. This guidance which can be fully separate from any support function serves to maintain a single defined position of the passageway even during transverse accelerations when the passageway is substantially supported on the carrier arms.

In order to relieve the car coupler from carrying the load of the passageway, and to permit suspending the portal halves on the carrier arms, a preferred embodiment provides that the two guiding arms have a path-limiting stop located at their common joint whose effect is to cause both guiding arms to constitute a rigid suspension beam which is itself supported by the two slides. In this way, the load is distributed in approximately equal parts on the two pivotal arms of both carriage boxes.

In order to permit a transfer of the entire weight of the passageway to one of the two car boxes in case the other of the two boxes experiences a failure of the pneumatic suspension, it is possible to mount path-limiting stops between the guiding arms and the slide. The effect of these stops is to cause the weight of the passageway to be assumed in such a case by the carriage box whose suspension is intact.

Preferably, each of the portal halves include a compression spring mounted between the carriage box and the carrier arm and acting in the longitudinal direction of the vehicle away from the carriage box, the result of which is that, when uncoupled, the corresponding portal half is pushed outwardly whereas, in the coupled condition, the two joined portal halves are held approximately in the middle between the two ends of the carriages.

In similar manner as in the ceiling region, a preferred exemplary embodiment of the invention provides internal shields at the sides of the passageway which cover the rubber membrane. These shields are mounted movably at the lateral box portal columns and pivot about the vertical axis.

The above and other objects and advantages of the invention will be apparent from the following description of exemplary embodiments, reference being made to the accompanying drawings.

DESCRIPTION OF THE PREFERRED EMBODIMENTS

PRELIMINARY CONSIDERATIONS

The six possible components of motion which the two coupled vehicle boxes may execute with respect to one another are shown in Table I.

TABLE I

| Motion | | Symbol | |
|---|---|---|---|
| Displacement parallel to longitudinal axis | along x | $\dot{x}$ | |
| Displacement parallel to transverse axis | along y | $\dot{y}$ | |
| Displacement parallel to vertical axis | along z | $\dot{z}$ | |
| Rotation about longitudinal axis | about x | $\dot{\dot{x}}$ | (Roll) |
| Rotation about transverse axis | about y | $\dot{\dot{y}}$ | (Pitch) |
| Rotation about vertical axis | about z | $\dot{\dot{z}}$ | (Yaw) |

When different constructions of the passageway are compared with one another, a characteristic role is played by the central transverse plane (CTP) both with respect to the types of constructional elements which lie in that plane or are adjacent thereto as with respect to its relative motion with respect to the two vehicles. Depending on the construction, the following elements are contained in the CTP:

A continuous folded diaphragm;

A non-separable central portal as an intermediate member between two diaphragms;

The separation plane of a central portal which consists of two separable halves;

The symmetry plane of a non-separable rigid tunnel tube;

The separation plane of a separable tunnel tube which is rigid when coupled.

The various possibilities of motion of the CTP with respect to the vehicle box motions in and about the Y and Z axes are shown in Table I.

Figure 1:
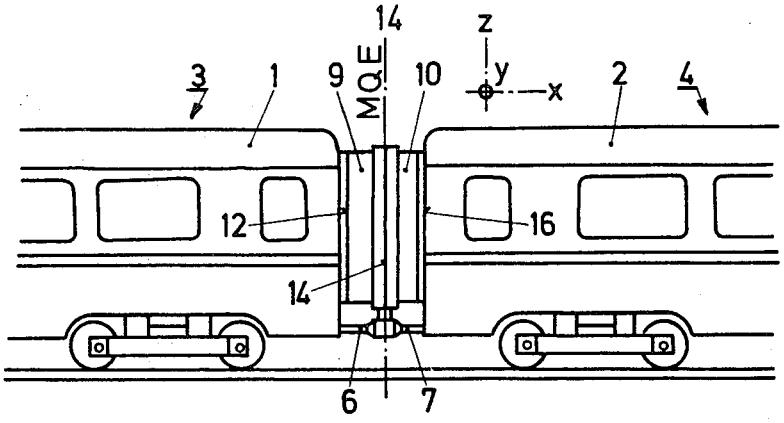
FIG. 1 is a side view of two vehicles including a passageway according to the invention.
Figure 2:
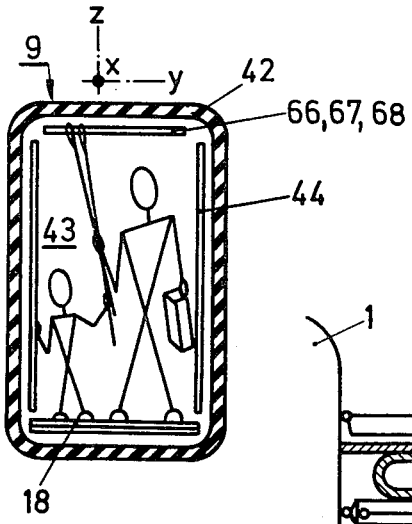
FIG. 2 is a schematic cross section through a passageway according to FIG. 1 with passengers in the passageway between two carriages of a moving train.

FIG. 1 of the drawing is a purely schematical representation of two vehicle boxes 1 and 2 belonging respectively to two railway cars 3 and 4 in a side view. The ends of the carriages 3 and 4 are provided respectively with vehicle couplers 6 and 7. The end faces 12 and 16 of the vehicle boxes 1 and 2 are provided with passageway bridges 9 and 10 which permit the walking passage of persons from one railway car to the other, as illustrated in the cross section of a passageway 9, 10, shown in FIG. 2. The separation plane 14, to which attaches a great significance, is designated with the letters CTP in FIG. 1. Illustrated in FIG. 2 are two persons in the process of walking across a bridge plate 18 in the passageway 9. It will be seen that the persons are completely protected against external influences.

Illustrated in FIGS. 1 and 2 are the three orthogonal axes X, Y, Z of a cartesian coordinate system to which further references will be made.

In the entire consideration for the purpose of conceptualizing optimum transfer or passageways in railway cars it is to be remembered that these bridges serve as passages and as shelter for railway passengers although they may execute continuous motion corresponding to the relative motion of the railway cars during the trip. Such passageways must also insure the protection of the passengers against external influences and furthermore protect the passageway itself against external and also internal detrimental effects of all kinds. In this general sense, one may distinguish between a number of functions serving the mobility of the passageway and a group of functions serving for protection. The problem is a typical "man-machine problem". The various steps which are taken to lead from the description of the problem to its solution are illustrated in the attached flow diagram.

TABLE II

FROM PROBLEM TO SOLUTION

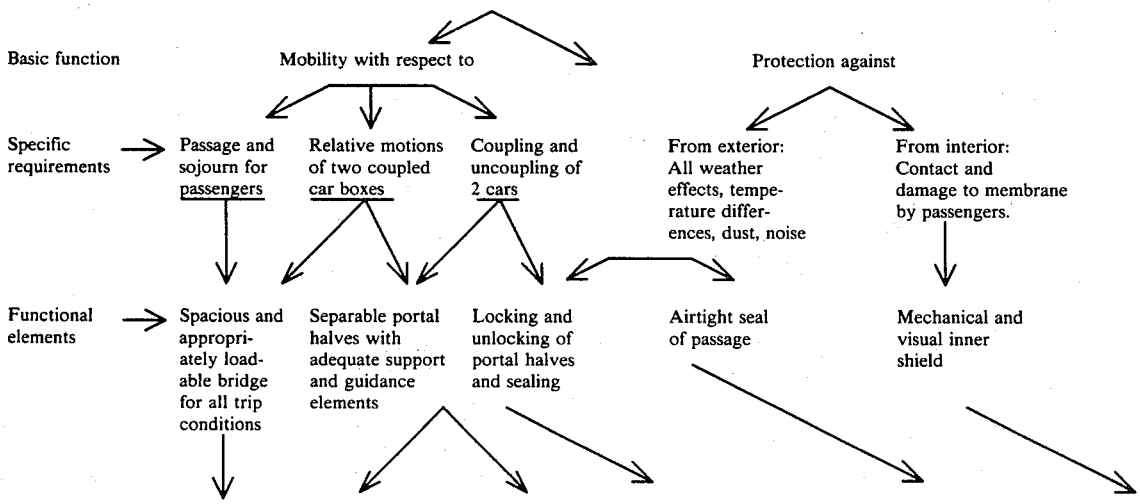

TABLE II-continued

| FROM PROBLEM TO SOLUTION | | | | | | |
|---|---|---|---|---|---|---|
| Concrete solutions for the passageway → | One half of the bridgeway attached to car, one half to portal threshold, the latter divided in movable bands; telescopic support for bridge | If possible, weight is supported by car couplers | Otherwise: Suspended on upper guidance system including spring tension rods | Spring-loaded automatic locking sliding bolts | Completely surrounding airtight flexible membrane of elastic material | Cover plates top and sides |
| | Bridge | Guidance mechanism | | Portal coupling | Membrane | Cover Plates |

Figure 3:
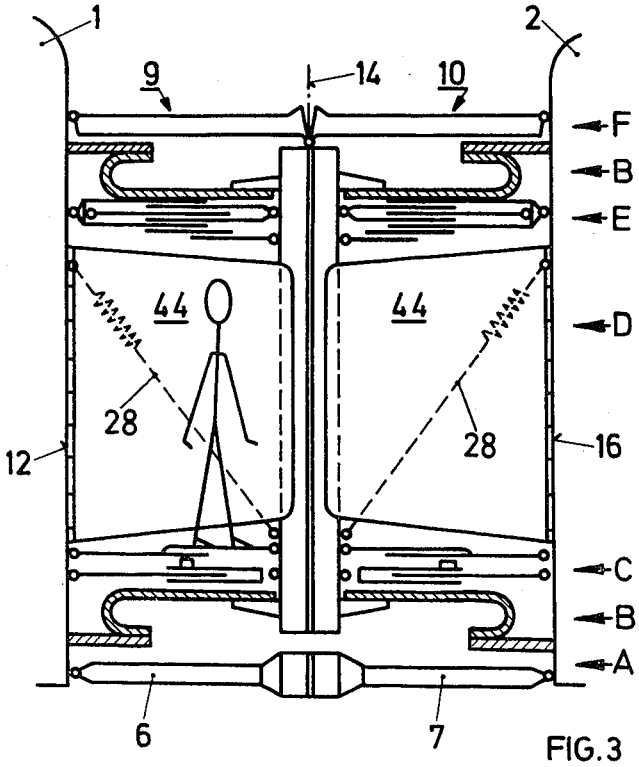
FIG. 3 is a schematic longitudinal section designating the principal constructional groups.
Figure 4:
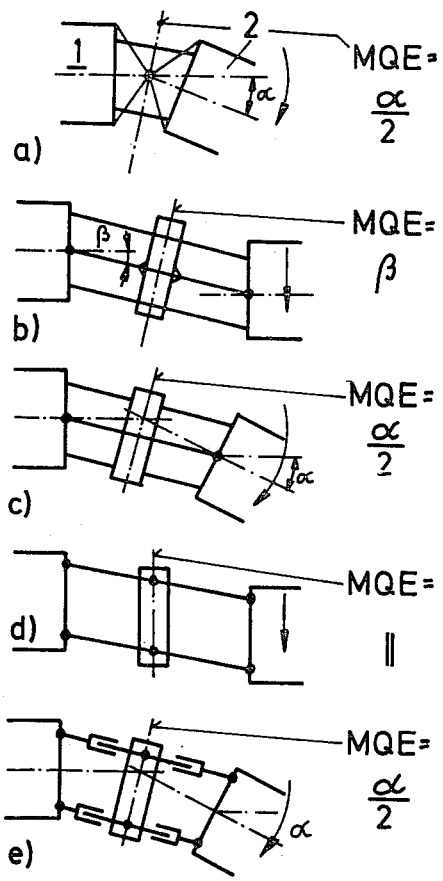
FIG. 4 is an illustration of five possibilities for constructing a passageway, analogous to that of FIG. 1, in schematic representation.

FIG. 3 is a schematic representation of a longitudinal schematic cross section through a passageway between two cars with the sides removed and includes the following constructional groups:

A. The vehicle coupler
B. An elastic bellows
C. A passageway bridge
D. A passenger region, lateral covering and linkages
E. An upper covering
F. An upper guidance system FIG. 4 is a set of diagrams illustrating the possibilities for pivotal motion of the passageway bridge between two vehicle boxes. The vehicle box 2 is pivoted relative to the box 1 or is moved parallel thereto. In each case, the terminal position of the CTP is shown. The individual illustrations 4a–4e may be regarded as side elevational views or as top views.

FIG. 4a illustrates a single pivot connection (see also FIG. 5a). This illustration relates only to a pivoting but not to a parallel displacement of the two vehicle boxes. Accordingly, this connection is not usable for two coupled individual vehicles although it may be used for two vehicle boxes which are supported on a common so-called Jakobs rotary truck. This manner of pivoting is not considered for the solution of the present problem.

The illustrations 4b and 4c show a connection between two pivots in which the CTP substantially follows the motion of one of the coupler rods 5. During a parallel displacement of the two vehicles boxes 1 and 2, the CTP is turned about an angle $\beta$ and during a pivoting of the boxes about the angle $\alpha$, it is pivoted by an angle $\alpha/2$.

The illustration 4d represents a parallel guidance in which a parallel displacement of the two vehicle boxes also results in a maintenance of the CTP in a parallel position. This combination permits pivoting only if the parallel linkage contains longitudinally displaceable members, such as are illustrated schematically in FIG. 4e.

Figure 5:
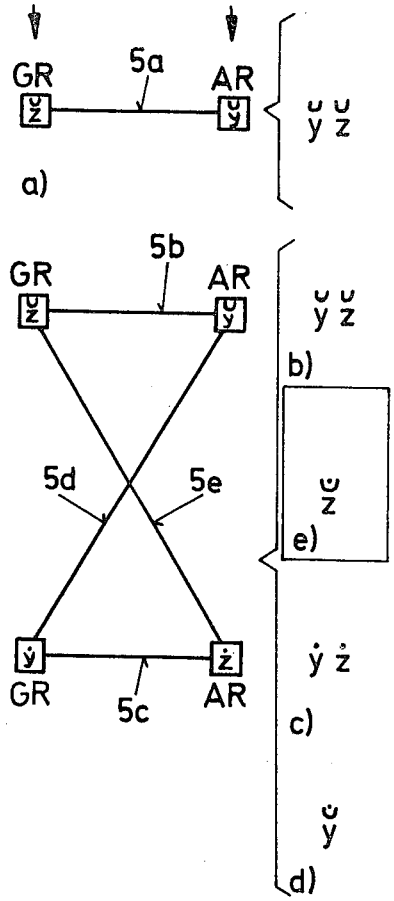
FIG. 5 illustrates possibilities for combining the cases of FIG. 4 and including a symbolic indication of possibilities of motion.

FIG. 5 is a schematic diagram in which the connecting lines represent the cases 5a–5e which correspond to the possibilities illustrated in FIG. 4 and which are shown as viewed with respect to a top view (GR) and a side view (AR). These motions are suitably characterized by the mobility symbols: $\overset{\cup\cup}{yz}$; $\overset{\cdot\cdot}{yz}$; $\overset{\cup}{y}$; $\overset{\cdot}{z}$. These and other symbols which are used below are combined in Table III.

TABLE III

The pivot linkage network is shown in a side view. The four main symbols are

TABLE III-continued

▭ = rigid links
⬭ = elastic links
○ = pivots (joints)
⊕ = two links can be coupled rigidly or completely separated The mobility symbols in a joint symbol have the meaning:

$\cup$ rotatable about
. displaceable in
} { z axis; vertical axis in
y axis; transverse to
x axis; longitudinal axis in } plane of drawing The number of mobility symbols yields the types of joints:

| | | |
|---|---|---|
| $\cup$ | pivotal, transmits rotation about the two other axes | pivots |
| $\cup\cup$ | two-axis pivot (universal joint) transmits rotation about third axis | pivots |
| $\cup\cup\cup$ | three axis pivot, transmits no torques | pivots |
| . | linear freedom of motion, straight line guidance, transmits forces in two other directions | sliding joints |
| . . | area freedom of motion, transmits forces in third direction, | sliding joints |
| . . . | spatial freedom of motion, transmits no translation forces | sliding joints |

Figure 6:
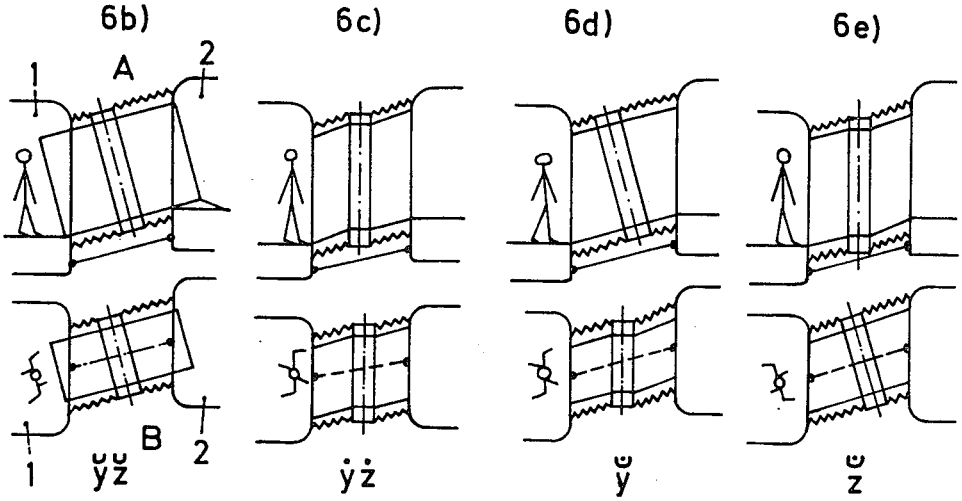
FIG. 6 is a set of schematic representations of the four possible combinations according to FIG. 5 in a side view and a top view.

FIG. 6 is a set of diagrams illustrating four combined possibilities of motion of the CTP as between the boxes 1, 2 of two cars 3, 4 and these are shown in a side view A and a top view B, in each case under the occurrence of a parallel displacement of the two boxes 1 and 2. These cases which are designated 6b–6e are the possibilities which are discussed critically below.

The cases 5a and 5b permit the utilization of a "rigid tube" but are not very suitable for large vertical displacement (a large path of the portal up or down). The case 5c is not very well suited for large lateral motions (large lateral displacements of the bridge). The case 5d combines the disadvantages of the cases 5b and 5c and is thus uninteresting. The case 5e seems best suited for large relative motions of the vehicle boxes 1, 2 in the vertical and horizontal directions.

When the problem of supporting the vertical forces is considered, the most important consideration must be given to the transmission of the vehicle weight and shock forces. Of course, constructive steps must be taken to accept also the longitudinal and transverse forces as well as all turning moments, all of these being of predominantly dynamic type. However, special attention must be paid to the vertical forces.

The essential conditions and possibilities relative to the vertical support of the passageway are summarized in Table IV and FIG. 6. These two illustrations have an identical subdivision although in one case the fields carry written text whereas in the other case they are provided with the associated sketch.

Particular attention should be paid to the variables:

Coupled-uncoupled,

With or without load,

Support by the coupler or no such support,

Normal operation or suspension breakage.

The superiority of the cases 5*e* or 6*e* may be demonstrated in construction because, especially for large motions and dimensions of the passageway, and for relatively limited spatial conditions for the mechanical parts and their motions, as well as for the normally occurring ratios of the installed masses and the relative motions, this case requires the least constructional space. In the CTP, the passageway occurs as approximately a rectangle in vertical configuration, so that, when large lateral displacements occur, the CTP may easily rotate about the vertical axis. During extreme vertical displacements, it is possible for reasons of space to accept displacements of the CTP in the z axis but not a rotation about the y axis. This results in priority for the cases 5*e* and 6*e* in the application discussed here.

The limitation to the case 5*e* in which the CTP has the motion represented by $\frac{y}{z}$, the following solutions are eliminated:

All one-point pivots according to case 5*a;*

All passageways according to case 5*b,* especially the previous solutions TEE and EWIII and the solution proposed in U.S. Pat. No. 417,567;

All solutions according to case 5*c,* especially that according to Swiss Pat. No. 424 852 and German Pat. No. 690 101;

The case 5*d* which has low probability.

A solution which probably comes closest to the present one is illustrated in U.S. Pat. No. B 2,826,998. However, this solution illustrates a system of pivots and links which cannot satisfy the modern requirements with respect to an exact and unambiguous motional guidance as well as an ability to adapt to relatively large motions, large passageway cross sections and automatic coupling. Furthermore, this solution is based on constructional elements such as, for example, diaphragms, bellows and leaf springs which do not correspond in any way to present day requirements with respect to freedom from maintenance, insulation from heat and sound, as well as low noise generation.

Figure 7:
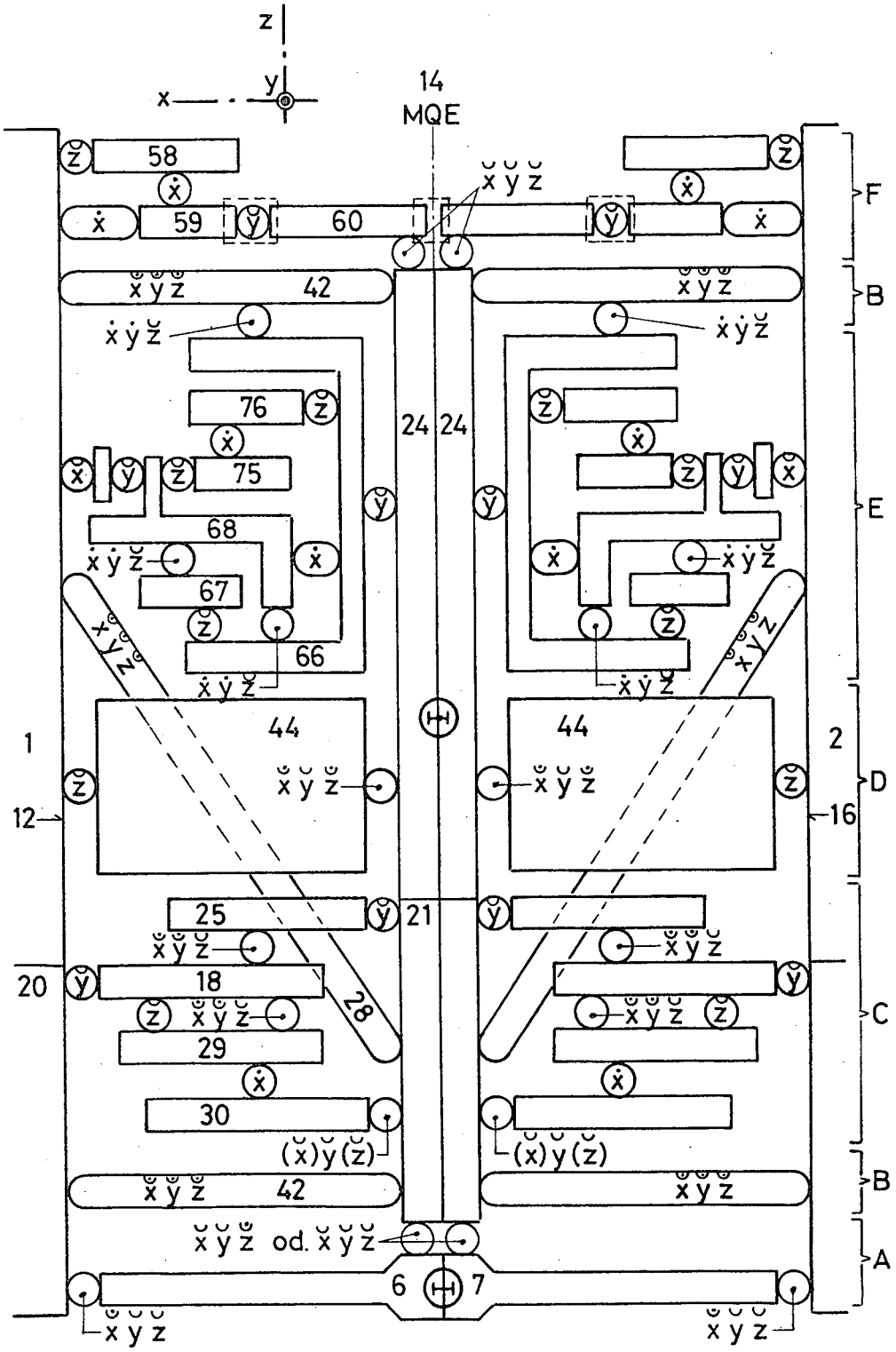
FIG. 7 is a schematic diagram in symbolic representation of a closed passageway bridge, illustrated as a mobility plan.

The schematic draftsman's representation of FIG. 7 has been used to represent a pivotal linkage network or a mobility plan. This plan includes rectangular bands which represent rigid elements, bands with rounded ends which represent elastic members and circles which represent pivots. Furthermore, the pivotal symbols are provided with the symbol representing the possibilities of motion with respect to the six components of motion in space. This symbolic representation is advantageous because the individual freedoms of motion, and especially their cooperation is only difficult to ascertain from the representation of pictorial elements and also because in this instance it is not important what the exact construction of the individual constructional elements (pivots and links) is and these may possibly be assumed to be known. It is rather the object of the mobility plan to represent the disposition of the links and the choice of the pivotal motion according to the invention in the clearest and most synoptic fashion.

Exemplary embodiments of construction of passageways between vehicle boxes will be described below.

FIG. 7 is a schematic representation of a basic embodiment of the passageway bridge according to the present invention whereas FIGS. 8–11 show a corresponding embodiment in side views and longitudinal sections. In FIG. 7, all the pivots are provided with the mobility symbols according to Table III but only the most important reference symbols are included for the purpose of clarity. In order to simplify the connections, FIGS. 7–11 are described together and attention should also be paid to FIGS. 1–3.

Disposed between two couplable vehicle boxes 1 and 2 belonging to two cars 3, 4 which can be coupled or uncoupled by a vehicle coupler 6 and 7, are two closed and also separable passageway systems 9, 10. The disposition and function of the elements beginning with the end face 12 of the box 1 up to the separation plane 14 is exactly symmetrical with respect to that of the other box 2 up to the separation plane 14. Accordingly, only the left half of FIGS. 7–11 will be considered below. The movable passage walkway system 9 has a bridge plate 18 which is pivotably attached in the manner of a hinge at one threshold 20 of the end face opening of the vehicle box where it pivots about a transverse axis 23. Rotatably disposed about a transverse axis 26 are bridge members 25 attached to a threshold 21 of a portal half 24 and the bridge members 25 glidingly lie on the bridge plate 18 attached to the car box. The bridge members 25 consist of individual adjacent elements 50–54 which are capable of close adhesion even when the bridge plate 18 on the box side undergoes rotations about the longitudinal axis. Disposed below the passage walkway 18, 25 is a support and guidance system. This system consists of a bridge support 29 attached to the box 1 by means of a two-axis pivot and whose purpose it is to support and guide the bridge plate 18 attached to the car box as well as to be connected to a bridge support attached to the portal by means of a longitudinally displaceable telescope mechanism. The bridge support 30 attached to the portal is connected to the portal half 24 by means of a two-axis (cardan) pivot 31.

The portal halves 24 are held in the central position between the two box end faces 12, 16 with respect to distance and angular position. In known manner, the passageway can be sealed by a completely closed surrounding rubber membrane 42. Lateral cover plates 44 may be attached so as to provide lateral shielding between the rubber membrane 42 and the passenger space 43 (FIG. 2). The lateral cover plates 44 may, for example, be pivotably attached to the box 1 by a hinge 46 extending in the vertical direction and may be glidingly supported on the central portion of the portal half 24. Spring tension rods 28 are also illustrated.

The passenger space 43 may also be covered at the top by means of a movable covering. This can consist of horizontal foils 66, 67, 68 which are mutually displaceable in the longitudinal direction in the manner of a telescope (parts 75 and 76) and which are supported pivotably at the box 1 or the portal half 24. The type of this and all other pivots chosen for the exemplary embodiment is apparent from the mobility plan (FIG. 7).

The carriages 3, 4 may be coupled by manual or automatic vehicle couplers 6, 7. The weight of the passageway when the cars are coupled is normally supported by the upper guidance including elements 57–64, however, if the vehicle coupler 6, 7 is suitably constructed, the latter may support the passageway partially or completely.

Figure 11:
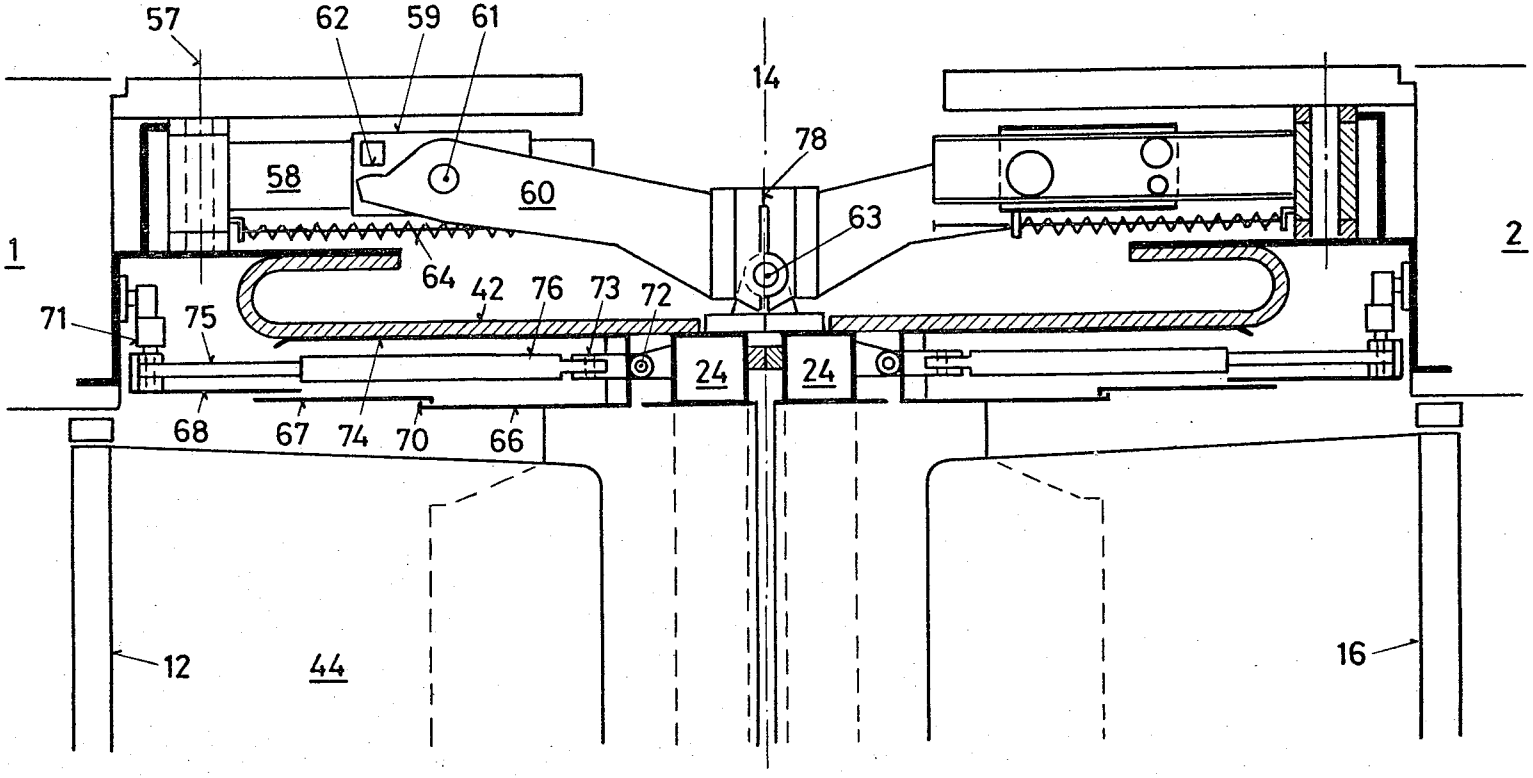
FIG. 11 is a longitudinal section through the upper guidance mechanism and the covering for the passageway.

The upper portal guidance, shown enlarged in FIG. 11, consists of a mechanical pivotal linkage between the carriage box and the associated portal half. A pivotal arm 58 which pivots about the vertical axis 57 is attached to the vehicle box 1. The pivotal arm 58 carries a slide 59 which is guided in the longitudinal direction. Rotatably attached to the slide 59 about a transverse axis 61 is a single or double support arm 60 which is pivotably and separably attached to the upper end of the portal half 24 at a joint 63.

The slide 59 is urged outwardly by a system of springs 64 so that, when the cars are uncoupled, the portal halves 24 assume their outermost position whereas, when coupled, the two joined portal halves 24 are held approximately in the middle between the two carriages 3, 4.

Further provided between the support arm 60 and the slide 59 are path-limiting stops 62 which limit the extent of the downward motion of the portal halves 24.

Depending on whether the vehicle couplers 6, 7 (FIG. 9) can be loaded with the weight of the passageway or not, two variants of construction result. In the first case, the upper guidance will be loaded with the weight of the passageway only under special conditions, namely when extreme differences occur in the vertical position of the two boxes 1 and 2. Normally however, the passageway is supported by the vehicle coupler 6,7. However, if the vehicle coupler 6, 7 cannot be loaded down with the weight of the passageway, the upper guidance system must support the weight of the passageway. In that case, there is provided a further stop 78 which limits the relative motion of the two support arms 60. As a result, the two support arms 60 form a rigid support yoke whose two ends are suspended from the two slides 58 and the center of which is loaded with the weight of the passageway.

Figure 8:
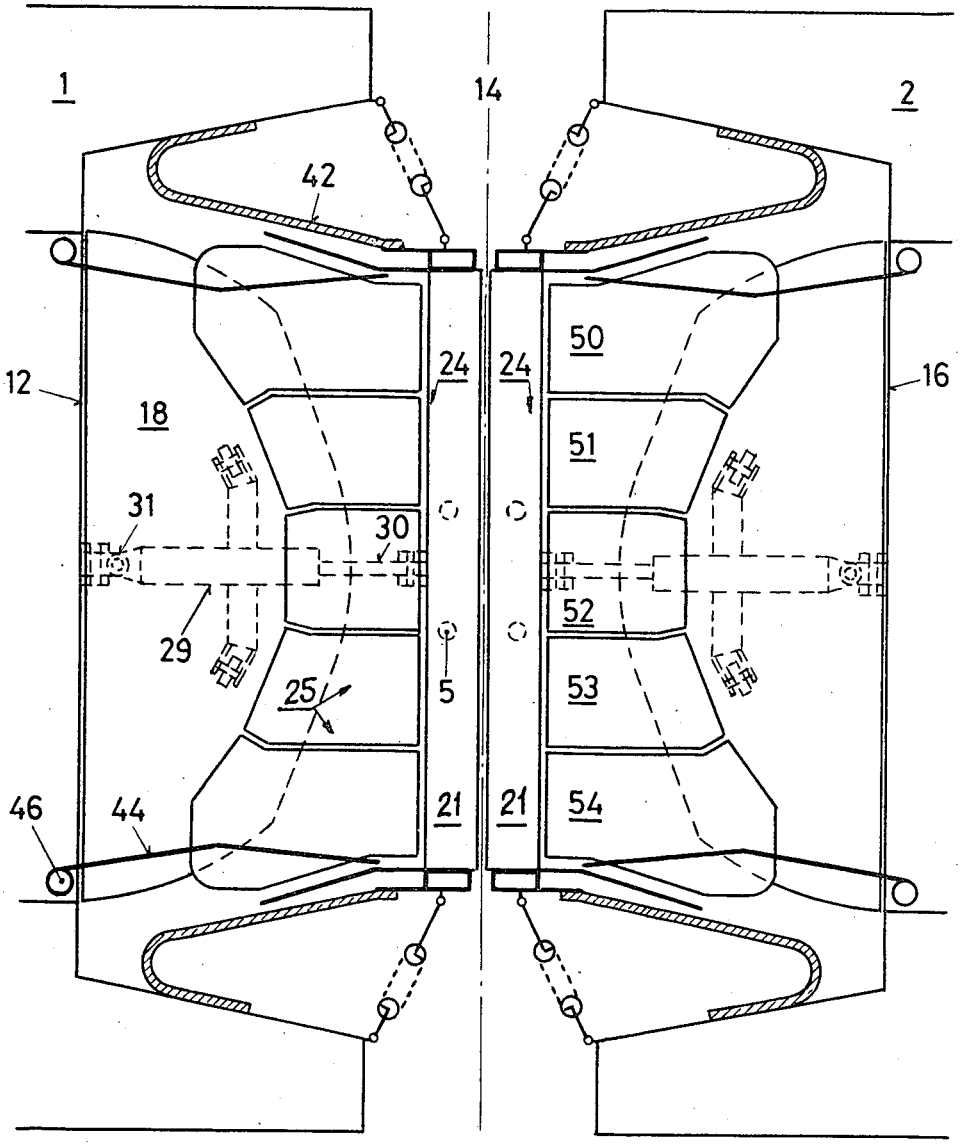
FIG. 8 is a top view of the passageway bridge with sectionally represented side membranes.
Figure 9:
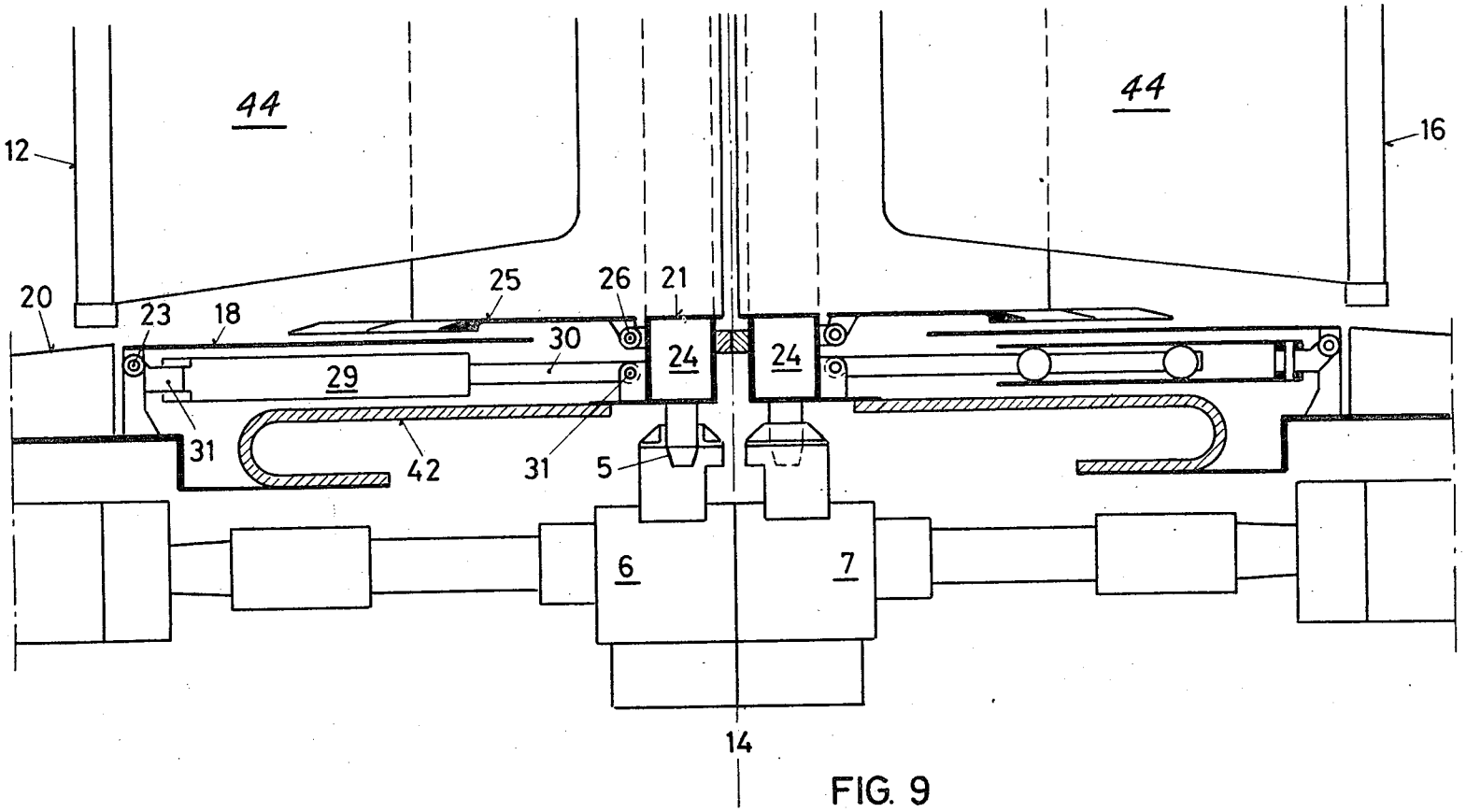
FIG. 9 is a longitudinal section through the passageway bridge.

The associated pivotal linkage chain may be gleaned from FIG. 7. The walkway bridge, which is seen in detail in FIGS. 8 and 9, is disposed between the vehicle boxes 1 or 2 and the associated respective portal half 24 at the height of the floor of the carriage 3 or 4. On the side of the carriage box, the approximately half-rounded plate 18 is pivotably attached to the transverse axis 23. The counter plate 25 is pivotably attached to the transverse axis 26 at the portal half 24 and is glidingly supported on the plate 18 attached to the car box. One of the two plates, in this case the plate 25, is subdivided into individually movable strips 50–54 so as to permit improved adaptation to motions in use. Disposed underneath the bridge plates 18, 25 is a telescopic carrier assembly 29, 30 connected between the carriage box 1 and the portal 24 and this assembly assumes the support function. In the exemplary embodiment shown, the bridge support 29 is a telescopic tube attached by a two-axis pivot 23, 31 beneath the bridge plate 18 on the car side. The cooperating telescopic rod 30 which is guided by the telescopic tube 29 is attached below the pivot of the bridge plate 25 at the portal side to rotate about a transverse axis 31. The bridge plate 18 is glidingly supported on the telescopic tube 29.

TABLE IV

| | | Type of construction and load<br>Support of the passageway on the vehicle coupler 6, 7 is | | | |
|---|---|---|---|---|---|
| | | permissible | | not permissible | |
| Operation during | | net weight only | w/payload | net weight only | with payload |
| during installation or delivery | uncoupled | Rigid rod (pendulum) mounted only for installation aid removed for normal operation | — | Spring tension rod 28 (elastic pendulum) as construction element; supports approximately net weight of passageway | x |
| Normal operation | coupled | All vertical forces are applied to coupler 6, 7 via elastic intermediate element and distributed over both car boxes | | | Vertical forces are distributed over both car boxes by central stop 18 and upper guidance |
| Extreme height difference e.g. suspension breakage | | Entire passageway suspended from upper guidance by box-side stop 62 of the car with damaged suspension | | As at left, except net weight of passageway supported by spring tension rods 18 from undamaged car | |

Figure 10:
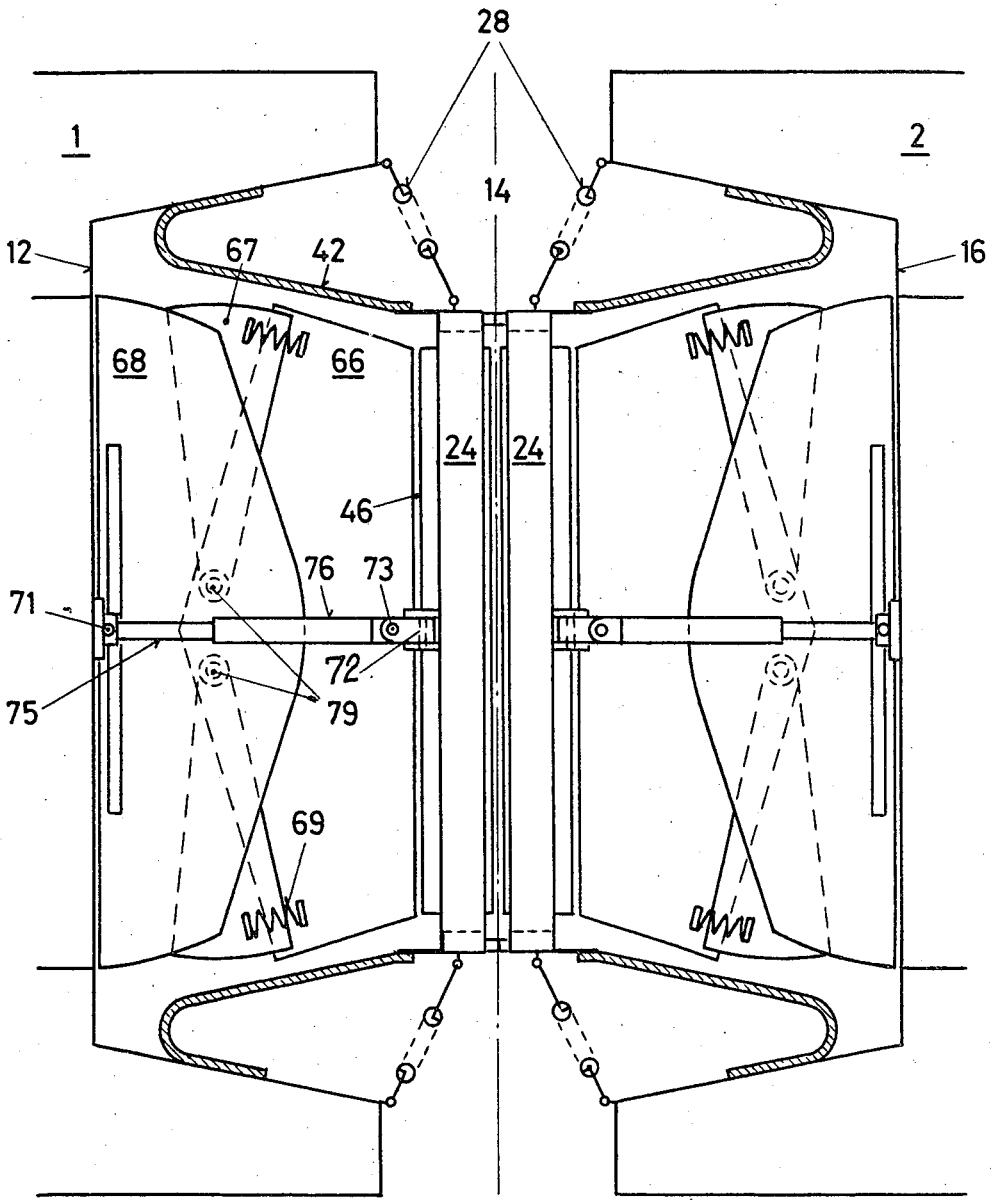
FIG. 10 is a top view of the covering of the passageway with sectionally shown lateral membranes.

The upper interior covering of a passageway between two railway vehicles which may be separated in a central transverse plane 14 and which is completely surrounded by, for example, a rubber membrane 42 is illustrated in FIGS. 10 and 11. The covering is composed of cover plates or foils 66, 67 and 68. One of the end plates 66 is attached to the central portal 24 of the passageway and pivots about the vertical axis of the joint 73 and about the transverse axis of the pivot 72. The other end plate 68 is attached by means of a two-axis joint 71 to the vehicle or the vehicle box 1. The partially overlapping plates 66 and 68 can be augmented as is clearly shown in FIGS. 10 and 11 by segment plates 67 for the purpose of completing the covering wherein the segment plates are pivotable about the vertical axis 79 at one or the other of the end plates 66 or 68. The entire assembly of plates is guided by a telescopic guidance 75 and 76 where, in the case shown, the piston part 75 of the telescope is attached to the carriage and the cylinder part 76 is attached to the passageway.

Advantageously, the segment plates 67 are so guided by means of compression springs 69 and stops 70 that, when the end plates 66 and 68 are widely separated, the segment plates cover the lateral gaps between them whereas, when the plates 66 and 68 are close together, the segment plates 67 are pushed between them. This construction prevents an uncontrolled to and fro motion under the influence of accelerating forces.

As shown in FIG. 11, the end plate 66 is pocket-shaped and its lower surface, as explained, serves as the end plate 66 whereas the upper surface 74 supports the rubber membrane 42.

The following remarks may be made with respect to the function of the motion-limiting stops 62 and 78 of the support arm 60.

Figure 12:
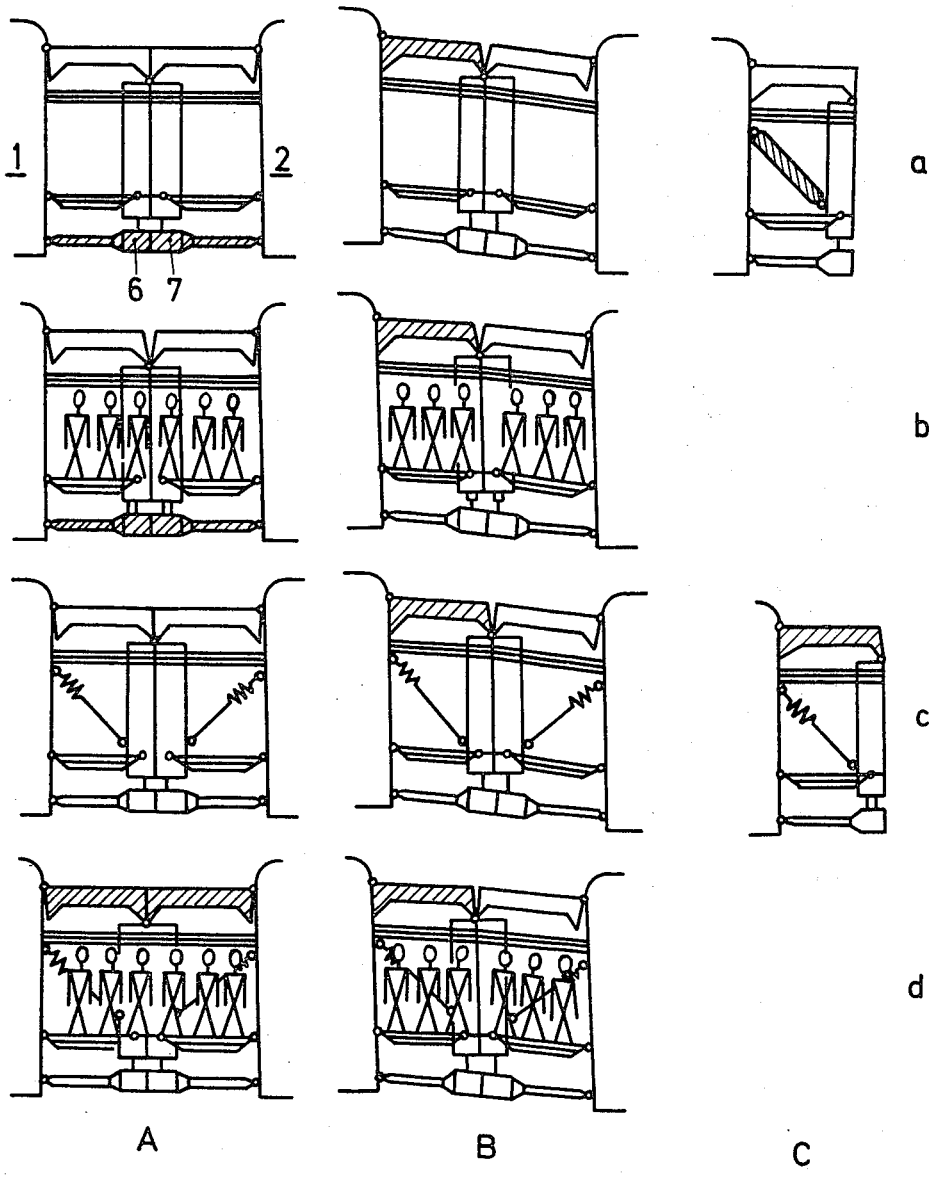
FIG. 12 represents different cases for using the passageway in schematic representations.

FIG. 12 is a set of schematic illustrations distributed over four rows a, b, c, d and three columns A, B, C in which various cases of the use of the passageways are shown. The rows a and b illustrate a passageway which is normally supported by the vehicle couplers 6, 7 but is always guided thereby. The rows c and d illustrate a passageway which is guided by the couplers 6 and 7 only in the horizontal direction but is not supported thereby. In rows a, c, the passageway is shown unoccupied whereas in rows b, c, it is shown loaded by the presence of passengers.

Column A illustrates the vehicles in the coupled state and in normal operation, column B illustrates the vehicles in the coupled state but with an extreme vertical distance between the two carriage boxes 1 and 2 and column C shows one of the vehicles uncoupled and thus unloaded.

The illustrations of FIG. 12 show the function of the upper motion limiting stops at both the box side and the portal side. In the drawing, those elements such as support arms, spring tension rods or vehicle couplers which carry the load are shown shaded.

The stop at the portal side which causes the upper support arms to be joined into a single continuous beam, becomes operative in the illustrated cases Ac and Ad in FIG. 12, whereas the stops at the carriage box come into play in the case Ba, Bb, Bc, Bd and Cc.

We claim:

1. A passageway for use between two coupled vehicles, especially railway vehicles, including a separable central portal including at least two pivot linkage systems and a multipart movable walkway bridge disposed between each end face of two vehicle boxes and an associated portal half, each bridge including a bridge plate fastened pivotably in the manner of a hinge at a threshold of an end face opening in a respective one of the vehicle boxes and further including bridge members attached at the portal side to the threshold of the portal half, said bridge plate and bridge members gliding on top of one another, characterized in that the passageway (18,25) is supported by a support frame (29,30) entirely enclosed by fully enclosing bellows (42).

2. A passageway according to claim 1, characterized in that the support frame is a bridge guidance having a box-side bridge support (29) attached to one of said boxes by a two-axis joint and serving to support the box-side bridge member (18) and also serving to guide by longitudinally displaceable telescopic action a portal-side bridge support (30) which is attached to the associated portal half (24) by a ball joint.

3. A passageway according to claim 1, characterized in that the passageway bridge (18,15) consists of two bridge plates (18,25), one of which is subdivided in the longitudinal direction into substantially parallel, individually movable elements (50-54).

4. A passageway system according to claim 2, characterized in that rollers (32) are disposed between the bridge supports (29, 30) and the lower bridge plates (18,25) for the purpose of reducing friction.

5. A passageway system according to claim 1, characterized in that there is provided a covering including two cover plates (66,68) disposed at each vehicle end, one of the cover plates (68) being pivotably attached at the car box 1 or 2 about a transverse and longitudinal axis (71) and the other of said cover plates (66) being pivotably attached to the central portal (24) of the passageway to pivot about a transverse axis and a vertical axis (72,73).

6. A passageway system according to claim 5, characterized in that the cover plates (66,68) partially overlap and are guided by a telescopic guidance (75,76) which is pivotably attached by one end (75) to a car box (1,2) and attached by its other end (76) to the central portal (24).

7. A passageway system according to claim 5 or 6, characterized in that segment plates (67) are disposed at least at one cover plate (66,68) to pivot about vertical axes (79), for the purpose of covering any remaining gaps.

8. A passageway system according to claim 7, wherein said segment plates (67) are guided by springs (69) and stops (70) such that when said cover plates (66,68) are far apart, the segment plates (67) cover the gaps therebetween whereas when said cover plates (66,68) are close together, the segment plates (67) are pushed therebetween.

9. A passageway system according to claim 5 or 6, characterized by a cover plate (74) attached to one of the cover plates (66) and preferably disposed above the telescopic guidance (75,76) for supporting the upper portion of an elastic sealing membrane (42).

10. A passageway system according to claim 1, characterized in that a lower releasable coupling rod (6) known per se is provided and is attached to a respective one of said vehicle boxes (1) with a ball joint-like fastener and capable of longitudinal spring action and guides the associated portal half (24) via a joint in the longitudinal and transverse directions, said coupling rod (6) being rigidly attached to or completely separable from the associated coupler rod (7) of the other said vehicle box (2).

11. A passageway system according to claim 1, characterized in that the lower side of the portal halves (24) is guided in the horizontal direction by means of vertical pins (5) and corresponding recesses in the vehicle couplers (6,7).

12. A passageway system according to claim 1, characterized by a compression spring (64) which acts in a longitudinal direction of its associated vehicle away from the corresponding vehicle box and is disposed between each of the two portal halves (24) and the associated respective ones of said vehicle boxes (1,2).

13. A passageway system according to claim 1, characterized by rigid tension rods serving as coupler aids and disposed between each of said vehicle boxes and the associated portal half (24).

14. A passageway system according to claim 1, characterized in that the passageway is protected interiorly with respect to the lateral part of a rubber membrane (42) by movable lateral shields (44) which are attached to lateral box portal columns to pivot in the manner of a hinge (46) about the vertical axis.

15. A passageway system according to claim 14, characterized by a movable sealing parts (66,67,68) for protecting the top of the passageway with respect to the upper portion of the rubber membrane (42), the sealing parts being supported and guided by telescopic guidance members (75,76).

16. A passageway system according to claim 1, characterized by spring tension rods (28) disposed between the each of said respective vehicle boxes (1 or 2) and the associated portal half (24), for holding the corresponding portal half (24) in approximately an average height position in an unloaded state.

17. A passageway for use between two coupled vehicles, especially railway vehicles, including a separable central portal, including at least two pivot linkage systems and a multi-part movable walkway bridge including an upper guidance for guiding the central portal, disposed above the walkway passage and including a support arm pivotable about a vertical axis disposed at the top part of the end face of a respective one of two vehicle boxes characterized in that the support arm (58) carries a longitudinal slidable slide (59) on which is attached an arm (60) which pivots about a transverse axis (61) and wherein a portal half is connected to the support arm (60) via a joint (63).

18. A passageway system according to claim 17, characterized in that there is provided a covering including two cover plates (66,68) disposed at each vehicle end, one of the cover plates (68) being pivotably attached at a respective vehicle box about a transverse and longitudinal axis (71), the other of said cover plates (66) being pivotably attached to the central portal (24) of the passageway to pivot about a transverse axis and a vertical axis (72,73).

19. A passageway system according to claim 18, characterized in that the cover plates (66,68) partially overlap and are guided by a telescopic guidance (75,76) which is pivotably attached by one end (75) to a respective one of said vehicle boxes (1,2) and attached by its end (76) to the central portal (24).

20. A passageway system according to claim 18 or 19, characterized in that segment plates (67) are disposed at least at one cover plate (66,68) to pivot about vertical axes (79), for the purpose of covering any remaining gaps.

21. A passageway system according to claim 20, wherein said segment plates (67) are guided by springs (69) and stops (70) such that when said cover plates (66,68) are far apart, the segment plates (67) cover the gaps therebetween whereas when said cover plates (66,68) are close together, the segment plates (67) are pushed therebetween.

22. A passageway system according to claim 18 or 19, characterized by a cover plate (74) attached to one of the cover plates (66).

23. A passageway system according to claim 22, wherein said cover plate (74) is disposed above the telescopic guidance (75,76) for supporting the uppoer portion of an elastic sealing membrane (42).

24. A passageway system according to claim 11, characterized in that a lower releasable coupling rod (6) is provided and is attached to one of said vehicle boxes (1) with a ball joint like fastener and capable of longitudinal spring action and guides the associated portal half (24) via a joint in the longitudinal and transverse directions, said coupling rod (6) being rigidly attached to or completely separable from the associated coupler rod of the other of said vehicle boxes.

25. A passageway system according to claim 17, characterized by stops (62) which limit the pivotal angle of guide arms (60), said stops (62) serving to cause the portal (24) to be suspended substantially from an unlowered one of said vehicle boxes (1,2) when the difference in height of two coupled vehicle boxes (1,2) is extreme.

26. A passageway system according to claim 25, characterized in that two guided arms (60) are provided with path-limiting stops (78) at their common central joint (63).

27. A passageway system according to claim 17, characterized in that a lower side of the portal halves (24) is guided in the horizontal direction by vertical pins (5) and corresponding recesses in vehicle couplers (6,7).

28. A passageway system according to claim 17, characterized in that support arms form a support yoke which, in the coupled state, is supported by two slides (59) and carries and guides the two joined portal halves (24) via the joint (63).

29. A passageway system according to claim 17, characterized by a compression spring (64) which acts in the longitudinal direction of its associated vehicle away from a corresponding vehicle box and is disposed between each of the two portal halves (24) and the associated respective ones of said vehicle boxes (1,2).

30. A passageway system according to claim 17, characterized in that the slide (59) is a roller slide.

31. A passageway system according to claim 17, characterized by rigid tension rods serving as coupler aids and disposed between respective said vehicle boxes (1,2) and the associated portal half (24).

32. A passageway system according to claim 17, characterized in that the passageway is protected interiorly with respect to the lateral part of a rubber membrane (42) by movable lateral shields (44) which are attached to lateral box portal columns to pivot in the manner of a hinge (46) about the vertical axis.

33. A passageway system according to claim 32, characterized by movable sealing parts (66,67,68) for protecting the top of the passageway with respect to the upper portion of the rubber membrane (42), the sealing parts being supported and guided by the telescopic guidance (75,76).

34. A passageway system according to claim 17, characterized by spring tension rods (28) disposed between respective said vehicle boxes (1 or 2) and the associated portal half (24), for holding the corresponding portal hald (24) in approximately the average height position in the unloaded stated.

* * * * *